US010076851B2

(12) United States Patent
Manchik

(10) Patent No.: US 10,076,851 B2
(45) Date of Patent: Sep. 18, 2018

(54) ADJUSTABLE RETURN STROKE LIMITER FOR A POWERED LOG SPLITTER

(71) Applicant: Daniel James Manchik, Lenox, MI (US)

(72) Inventor: Daniel James Manchik, Lenox, MI (US)

( * ) Notice: Subject to any disclaimer, the term of this patent is extended or adjusted under 35 U.S.C. 154(b) by 342 days.

(21) Appl. No.: 15/130,427

(22) Filed: Apr. 15, 2016

(65) Prior Publication Data

US 2016/0303760 A1 Oct. 20, 2016

Related U.S. Application Data

(60) Provisional application No. 62/148,374, filed on Apr. 16, 2015.

(51) Int. Cl.

| | |
|---|---|
| ***B27L 7/06*** | (2006.01) |
| ***B27L 7/00*** | (2006.01) |
| *F15B 9/12* | (2006.01) |

(52) U.S. Cl.

CPC ..... *B27L 7/06* (2013.01); *B27L 7/00* (2013.01); *F15B 9/12* (2013.01)

(58) Field of Classification Search

CPC ..... B27L 7/00; B27L 7/06; B27L 7/08

See application file for complete search history.

(56) References Cited

U.S. PATENT DOCUMENTS

| | | | | |
|---|---|---|---|---|
| 5,373,877 A * | 12/1994 | Chapman | ..... | B27L 7/00 144/193.1 |
| 2006/0060262 A1* | 3/2006 | Hicks | ..... | B27L 7/00 144/193.2 |
| 2016/0318206 A1* | 11/2016 | Banjo | ..... | B27L 7/06 |

* cited by examiner

*Primary Examiner* — Matthew G Katcoff

(74) *Attorney, Agent, or Firm* — Young Basile Hanlon & MacFarlane, P.C.

(57) ABSTRACT

An apparatus and methods for limiting the return stroke and modifying the extension stroke of a log splitter. A control rod is translated in the direction of the return stroke of the log splitter. An effort end of a trip arm coupled to the control rod is moved in the direction of the translation and a load end of the trip arm is moved in the opposite direction. The rotation of the load end causes a control lever of the log splitter to move from its rearward position to an intermediate position thereby stopping the return stroke.

20 Claims, 6 Drawing Sheets

ADJUSTABLE RETURN STROKE LIMITER FOR A POWERED LOG SPLITTER

CROSS-REFERENCE TO RELATED APPLICATION(S)

This application claims the benefit of U.S. Provisional Application No. 62/148,374, filed Apr. 16, 2015, the entire contents of which are hereby incorporated by reference in its entirety.

TECHNICAL FIELD

This disclosure relates to powered log splitters, and more particularly, to an adjustable return stroke limiter for a powered log splitter.

BACKGROUND

Powered log splitters are used to save time and labor in performing a longitudinal splitting operation on a log. Many of these log splitters include a frame supporting a splitting assembly with a wedge and a footplate, and a ram assembly that actuates the splitting assembly.

The ram assembly typically includes a double acting linear actuator fixed to the frame, and a manually operated control lever operatively coupled to the linear actuator to activate its extension stroke and return stroke. Either the wedge or the footplate is fixed to the linear actuator, and the other of the wedge and the footplate is fixed, in opposition, to the frame. With the linear actuator having previously completed a return stroke, the wedge and the footplate are in an open configuration accommodating the placement of a longitudinally oriented log between them. Then, an extension stroke and a return stroke of the linear actuator together correspond to a work cycle for the log splitter. During the extension stroke, a longitudinal splitting operation is performed on the log. At the end of the return stroke, the wedge and the footplate are once again left in an open configuration accommodating the removal of the split log and the placement of another longitudinally oriented log between them.

In the typical log splitter, the stroke of the linear actuator is long enough to allow for the open configuration of the wedge and the footplate to accommodate the placement of longer length, longitudinally oriented logs between them. However, for shorter length logs, the full stroke of the linear actuator is unnecessary.

SUMMARY

Disclosed herein are methods and apparatuses for limiting the return stroke of a log splitter.

One aspect of the disclosed embodiments is a stroke-limiting apparatus for a log splitter, including a trip arm with a load end and an effort end, wherein rotation of the load end causes movement of a control lever of the log splitter, wherein the control lever has a forward position activating an extension stroke of the log splitter, a rearward position activating a return stroke of the log splitter, and an intermediate position stopping the extension stroke or the return stroke. The apparatus also includes a control rod coupled to the effort end of the trip arm, the control rod including a first rod end, wherein translation of the first rod end causes the effort end of the trip arm to move in a direction of the translation and causes the load end of the trip arm to move in a direction opposite the direction of the translation, and wherein movement of the load end of the trip arm in the direction opposite the direction of the translation during the return stroke causes the control lever to move from the rearward position to the intermediate position.

Another aspect is a method for limiting the return stroke of a log splitter, including: using a wedge of the log splitter, engaging a push block coupled to a first end of a control rod to translate the first end of the control rod in a direction of the return stroke; using the translation of the first end of the control rod rotating an effort end of a trip arm coupled to the control rod in a direction of the translation; using the rotation of the effort end of the trip arm, rotating a load end of the trip arm in a direction opposite the translation to move the trip arm to a trip position; and using the rotation of the load end of the trip arm, moving a control lever of the log splitter from a rearward position to an intermediate position to limit a length of the return stroke of the log splitter.

Another aspect is a method for modifying an extension stroke of a log splitter, including: in response to a control lever of the log splitter moving to a forward position, disengaging a push block connected to a first end of a control rod in a stroke-limiting apparatus from a wedge of the log splitter, wherein disengaging the push block causes the first end of the control rod to translate in the direction of the extension stroke and the log splitter to perform the extension stroke; using the translation of the first end of the control rod, rotating an effort end of a trip arm of the stoke-limiting apparatus in the direction of the translation; and using the rotation of the effort end of the trip arm, rotating a load end of the trip arm in a direction opposite the translation to move the trip arm to a clear position, wherein the clear position allows the control lever to move to a rearward position activating a return stroke and an intermediate position stopping the return stroke or the extension stroke.

These and other aspects will be disclosed in additional detail below.

BRIEF DESCRIPTION OF THE DRAWINGS

The various features, advantages and other uses of the present apparatus will become more apparent by referring to the following detailed description and drawings in which like reference numbers refer to like elements.

DETAILED DESCRIPTION

An example of an accessory for a powered log splitter is described below that limits a linear actuator's return stroke by deactivating the return stroke before its otherwise normal completion.

Figure 1:
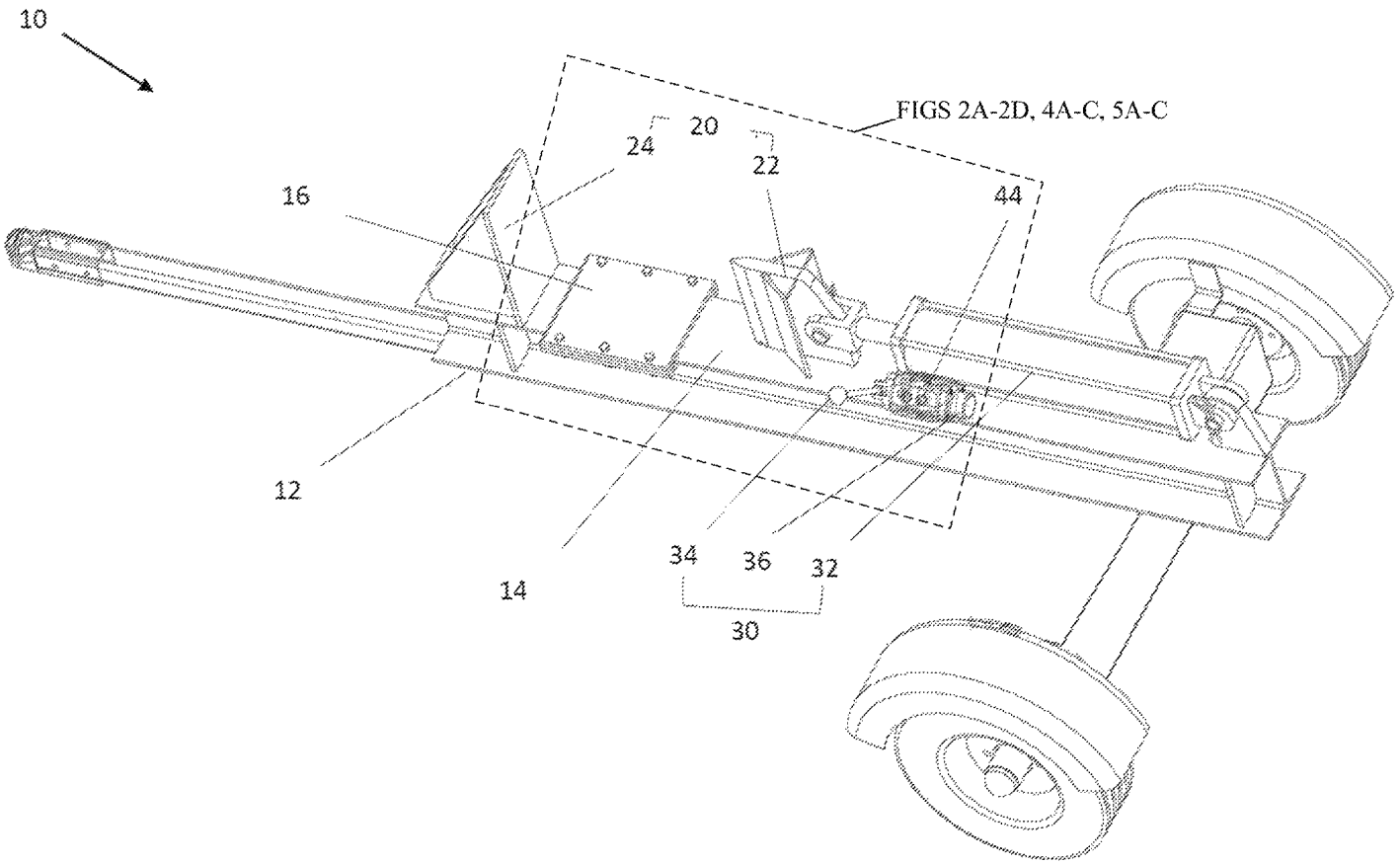
FIG. 1 (PRIOR ART)
FIG. 1 is a perspective view of a powered log splitter including a frame, a double acting linear actuator fixed to the frame, a wedge fixed to the linear actuator, a footplate fixed to the frame in opposition to the wedge and a manually operated control lever operatively coupled to the linear actuator to activate and deactivate its extension stroke and its return stroke.

An example of a typical powered log splitter 10 is shown in FIG. 1. The log splitter 10 includes an elongate frame 12 that supports a splitting assembly 20 and a ram assembly 30.

In the illustrated example of the log splitter 10, the frame 12 is horizontally oriented, and in this example, the frame 12 further supports an elevated loading platform 14. The loading platform 14 may be, or include, any surface or combination of surfaces suitable for supporting a log 16 (shown on FIG. 3B) in a longitudinal orientation along the frame 12. In other examples of the log splitter 10, the frame 12 may be vertically oriented or subject to selective vertical orientation. In these examples, it will be understood that the loading platform 14 may optionally be eliminated.

The splitting assembly 20 and the ram assembly 30 collaboratively support the performance of a longitudinal splitting operation on a log 16 supported on the loading platform 14.

The splitting assembly 20 includes a wedge 22 and a footplate 24. The wedge 22 is generally configured to penetrate one end of the log 16 when engaged with the end of the log 16 under force. This penetration initially creates a longitudinal split in the log 16, which is propagated with further penetration by the wedge 22 until the log 16 is ultimately substantially or wholly split. The footplate 24 opposes the wedge 22, and is generally configured to engage the other end of the log 16 and oppose the forces acting on the log 16 during engagement and penetration by the wedge 22.

The ram assembly 30 actuates the splitting assembly 20 by selectively moving the wedge 22, the footplate 24, or both between an open configuration and a closed configuration through an intermediate configuration. In the illustrated log splitter 10, the ram assembly 30 includes a double acting linear actuator 32 longitudinally oriented along the frame behind the wedge 22. The linear actuator 32 may be a hydraulic cylinder, as shown, or a pneumatic cylinder or an electric linear actuator, for example. As shown, the linear actuator 32 and the footplate 24 are fixed to the frame 12, and the wedge 22 is fixed to the linear actuator 32 in opposition to the footplate 24. It will be understood that the wedge 22 may alternatively be fixed to the frame 12, with the footplate 24 fixed to the linear actuator 32.

The linear actuator 32 has an extension stroke and a return stroke. The ram assembly 30 further includes a manually operated, multiple position control lever 34 operatively coupled to the linear actuator 32 to activate and deactivate its extension stroke and its return stroke.

As shown with additional reference to FIGS. 2A-D, in the illustrated log splitter 10, the control lever 34 is mounted atop the linear actuator 32, and its positions are aligned in the direction of the longitudinal orientation of the linear actuator 32. As shown, the control lever 34 has a forward position F/E that activates the extension stroke of the linear actuator 32, a rearward position R/R that activates the return stroke of the linear actuator 32 and an intermediate position I/D that deactivates the stroke of the linear actuator 32. Where the linear actuator 32 is, as shown, a hydraulic cylinder, the control lever 34 may, for example, activate a control valve 36 operatively coupled between the linear actuator 32 and a hydraulic oil pump (not shown), an engine (not shown) and other componentry powering the stroke of the linear actuator 32. As explained below, in the illustrated example of the log splitter 10, the control valve 36 may have an outer surface defining a number of exposed threaded holes 44.

Figure 2A:
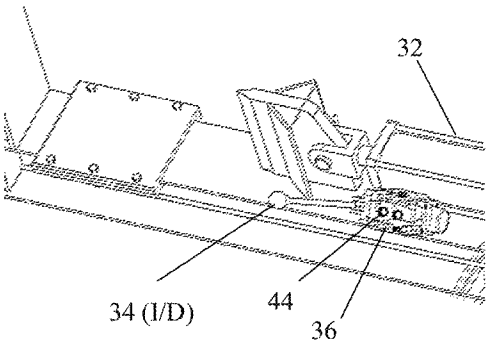
FIG. 2A (PRIOR ART)
FIGS. 2A-D include perspective views of the log splitter, showing the operation of the control lever and the corresponding activation and deactivation of the linear actuator's extension stroke and return stroke.

In the log splitter 10, an extension stroke and a return stroke of the linear actuator 32 together correspond to a work cycle for the log splitter 10. As shown in FIG. 2A, initially, with the stroke of the linear actuator 32 deactivated after having completed a return stroke in a previous work cycle, the control lever 34 is positioned in its intermediate position I/D, and the wedge 22 and the footplate 24 are in an open configuration accommodating the placement of the longitudinally oriented log 16 between them on the loading platform 14.

Figure 2B:
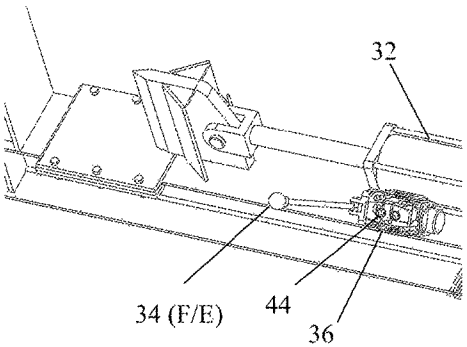
FIG. 2B (PRIOR ART)

As shown in FIG. 2B, to begin a new work cycle, the control lever 34 is positioned in its forward position F/E to commence an extension stroke of the linear actuator 32. During the extension stroke, the linear actuator 32 advances the wedge 22 through an intermediate configuration in which the wedge 22 and the footplate 24 are in relatively closer proximity. This engages the wedge 22 with the end of the log 16 facing the wedge 22 and the footplate 24 with other end of the log 16, and initiates penetration by the wedge 22 to create a longitudinal split in the log 16. As the extension stroke continues, the linear actuator 32 further advances the wedge 22 to propagate the longitudinal split in the log 16 until the log 16 is ultimately substantially or wholly split.

Figure 2C:
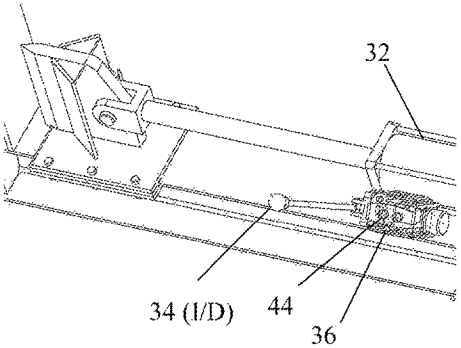
FIG. 2C (PRIOR ART)
Figure 2D:
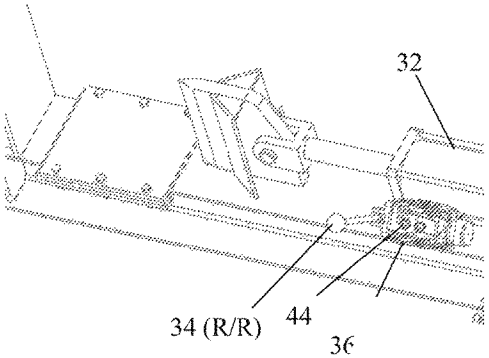
FIG. 2D (PRIOR ART)

As shown in FIG. 2C, at the completion of the extension stroke, the control lever 34 is repositioned in its intermediate position I/D to deactivate the stroke of the linear actuator 32, leaving the wedge 22 adjacent to the footplate 24 in a closed configuration. This positioning of the control lever 34 may occur manually or automatically by operation of the control valve 36, for instance. Then, as shown in FIG. 2D, the control lever 34 is positioned in its rearward position R/R to commence a return stroke of the linear actuator 32. At the end of the return stroke, the control lever 34 is positioned in its intermediate position I/D, as shown in FIG. 2A, to deactivate the stroke of the linear actuator 32, once again leaving the wedge 22 and the footplate 24 in an open configuration accommodating the removal of the split log 16 and the placement of another longitudinally oriented log 16 between them on the loading platform 14. This positioning of the control lever 34 may occur manually or automatically by operation of the control valve 36, for instance. The end of the return stroke completes the work cycle.

It can be seen that the time it takes to complete a work cycle for the log splitter 10 is the product, among other things, of the stroke of the linear actuator 32. In the typical log splitter 10, the stroke of the linear actuator 32 is long enough to allow for the open configuration of the wedge 22 and the footplate 24 to accommodate the placement of longer length, longitudinally oriented logs 16 between them on the loading platform 14. The stroke of the linear actuator 32 may, for example, be approximately 25 inches. However, for shorter length logs 16, for instance, 12-18 inch logs 16 commonly used in household fireplaces, the full stroke of the linear actuator 32 is unnecessary. With shorter length logs 16, both time and energy are wasted at the beginning of a work cycle, during the extension stroke, to engage the wedge 22 with the end of the log 16 facing the wedge 22 and the footplate 24 with other end of the log 16, and at the end of the work cycle, during the return stroke, to fully complete the return stroke even after the wedge 22 and the footplate 24 are far enough apart to accommodate the removal of the split log 16 and the placement of another longitudinally oriented log 16 between them on the loading platform 14.

Figure 3A:
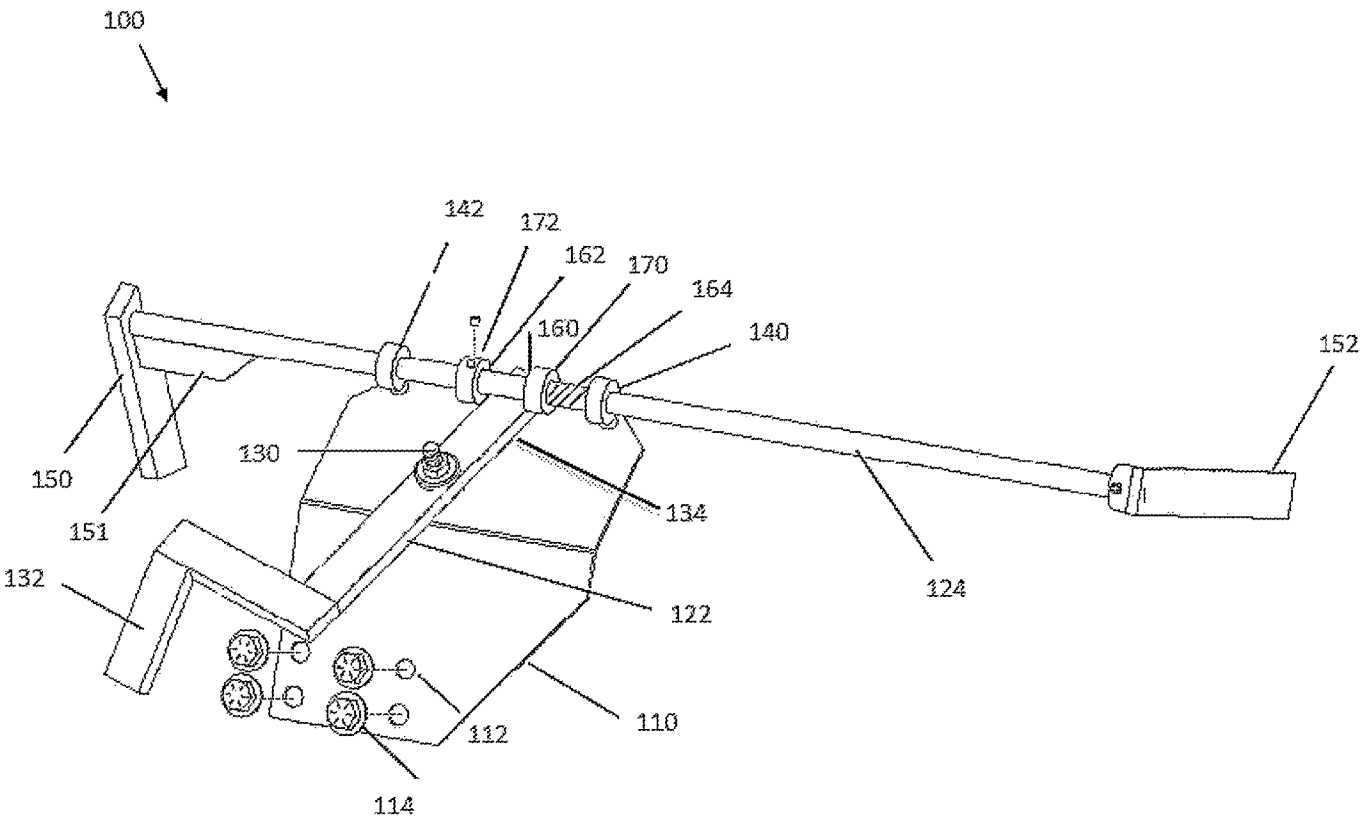
FIG. 3A is a perspective view of an example of an adjustable return stroke limiter that is configured for installation to the log splitter, and that includes a mounting bracket supporting a trip arm for operating the control lever to deactivate the linear actuator's return stroke, and a control rod for actuating the trip arm in response to the linear actuator.
Figure 3B:
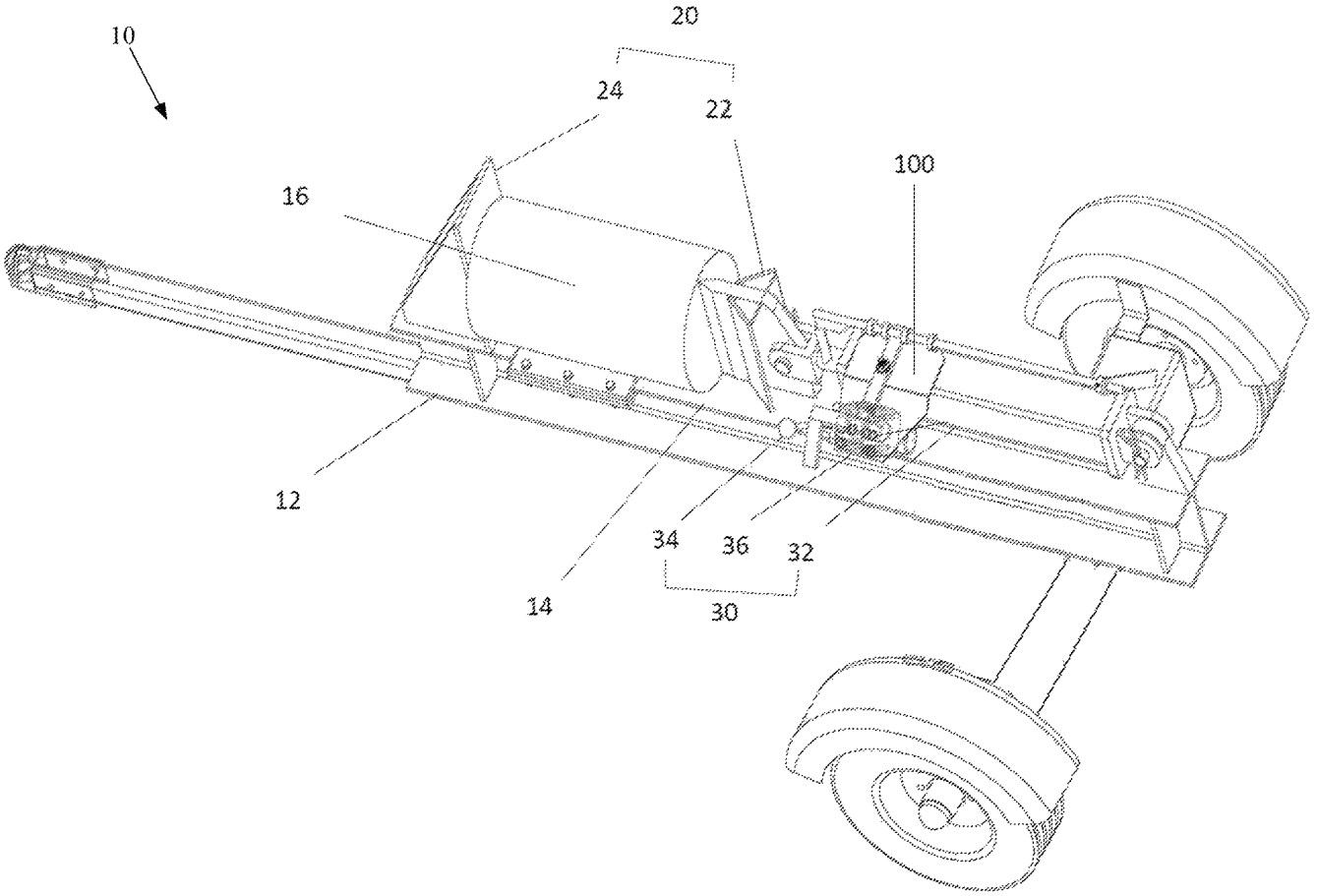
FIG. 3B is a perspective view of an example of an adjustable return stroke limiter installed to the log splitter.

FIG. 3A shows an example of an adjustable return stroke limiter 100 that reduces or eliminates the wasted time and energy associated with the work cycle of the log splitter 10 with shorter length logs 16. FIG. 3B shows a perspective view of an example of an adjustable return stroke limiter 100 installed to log splitter 10.

The return stroke limiter 100 is an accessory that, as explained below, installs to the log splitter 10 and, in operation, limits the return stroke of the linear actuator 32.

The return stroke limiter 100 includes a mounting bracket 110 supporting a trip assembly 120. The mounting bracket 110 is generally configured for installation to the log splitter 10. With the illustrated example of the log splitter 10, the mounting bracket 110 may, as shown with additional reference to FIGS. 4A-C and 5A-C, be configured for installation to the control valve 36 activated by the control lever 34. According to this example, the mounting bracket 110 defines a number of apertures 112 that are spaced to align with the threaded holes 44 of the control valve 36, with each sized to receive a threaded fastener 114 for a respective threaded hole 44.

The mounting bracket 110 can be attached to the control valve 36 by aligning its apertures 112 with the threaded holes 44 of the control valve 36, and by engaging the threaded fasteners 114 with the threaded holes 44 through the apertures 112. In this manner, the existing configuration of the control valve 36 may be used to implement the installation of the mounting bracket 110. With either the illustrated or other examples of the log splitter 10, it will be understood that the log splitter 10, the mounting bracket 110 or both may be differently configured to support the installation of the mounting bracket 110 to the control valve 36 or otherwise to the log splitter 10. In an embodiment, a spacer (not shown), with apertures aligning with the apertures of mounting bracket 110, can be inserted between mounting bracket 110 and control valve 36 to provide, for example, more clearance to pivot 130. In another embodiment, mounting bracket 110 can define apertures (not shown) to, for example, reduce the weight of apparatus 100, remove sharp corners from apparatus 100, and enable a less obstructed view of components of log splitter 10.

Once installed, the mounting bracket 110 operably supports the trip assembly 120 with respect to the linear actuator 32 and the control lever 34. The trip assembly 120 is responsive to the linear actuator 32 during its return stroke to operate the control lever 34 to deactivate the return stroke before its otherwise normal completion. In the illustrated example, the trip assembly 120 includes a trip arm 122 for operating the control lever 34 to deactivate the return stroke of the linear actuator, and a control rod 124 responsive to the linear actuator 32 during its return stroke for actuating the trip arm 122.

In the illustrated implementation, the trip arm 122 generally functions as a lever that is actuated by the control rod 124 to operate the control lever 34. As shown, the trip arm 122 is supported by the mounting bracket 110 on a pivot 130, and includes a load end 132 and an effort end 134 opposed about the pivot 130. With the trip arm 122 supported on the pivot 130, the load end 132 is positioned to operate the control lever 34, and the effort end 134 is positioned for coupling to the control rod 124 to subject the trip arm 122 to actuation by the control rod 124. The pivot 130, as generally shown, may be implemented in whole or in part by bolting the trip arm 122 to the mounting bracket 110.

As shown throughout FIGS. 4A-C and 5A-C, the trip arm 122 is supported on the pivot 130 for pivotal movement between a trip position T and a clearance position C. The movement of the load end 132 with movement of the trip arm 122 is generally aligned with the positions of the control lever 34 in the direction of the longitudinal orientation of the linear actuator 32. With the trip arm 122 in its clearance position C, the load end 132 occupies a space behind the positions of the control lever 34. With the trip arm 122 in its trip position T, the load end 132 still occupies a space still behind the forward position F/E and the intermediate position I/D of the control lever 34, but shared with the rearward position R/R that activates the return stroke of the linear actuator 32.

Thus, with the trip arm 122 in its clearance position C, the control lever 34 may be positioned in its intermediate position I/D, forward position F/E or rearward position R/R. However, with the trip arm 122 in its trip position T, the control lever 34 may no longer take its rearward position R/R. If the control lever 34 is positioned in its rearward position R/R, with movement of the trip arm 122 from the clearance position C to the trip position T, the load end 132 will engage the control lever 34 and reposition the control lever 34 to its intermediate position I/D that deactivates the stroke of the linear actuator 32.

In the illustrated implementation, the control rod 124 is supported by the mounting bracket 110 in the direction of the longitudinal orientation of the linear actuator 32. With the control rod 124 supported by the mounting bracket 110, the control rod 124 is coupled between the linear actuator 32 and the effort end 134 of the trip arm 122 to subject the trip arm 122 to actuation in response to the linear actuator 32 during its return stroke. The control rod 124 may be supported by the mounting bracket 110 in any manner for axial movement, and optionally, rotational movement. The mounting bracket 110 may, for example, include spaced eye bolts 140 and 142 for supporting the control rod 124.

The control rod 124, at one end, includes a radially extending push block 150. The push block 150 is suspended by the control rod 124 in an operative position. To reduce stress on push block 150, a reinforcement, such as a gusset 151, may be added between control rod 124 and push block 150. In its operative position, the push block 150 occupies a space that is behind the wedge 22 fixed to the linear actuator 32, but that would be shared with the wedge 22 during the return stroke of the linear actuator 32 before the return stroke's otherwise normal completion. Thus, with the push block 150 in its operative position, the wedge 22 will engage the push block 150 during the return stroke of the linear actuator 32 and axially move the control rod 124 in the direction of the return stroke.

At its other end, the control rod 124 may optionally include a radially extending handle 152 adapted to support manual rotational movement of the control rod 124 that swings the push block 150 out of its operative position. As generally shown, the orientation and position of the handle 152 may be selectively fixed by a set screw, for example, according to clearance requirements or other design considerations.

Behind the push block 150, the control rod 124 crosses the effort end 134 of the trip arm 122, and is coupled to the effort end 134 to subject the trip arm 122 to actuation. In the illustrated example of the control rod 124, the control rod 124 includes structure defining longitudinally spaced radially extending shoulder surfaces 160 and 162 cradling the effort end 134 of the trip arm 122.

Thus, with the trip arm 122 supported on the pivot 130, the shoulder surface 160 will engage the effort end 134 of the trip arm 122 with axial movement of the control rod 124 against the direction of the return stroke of the linear actuator 32 to move the trip arm 122 to its clearance position C. Optionally, a spring 164 may be coupled between the mounting bracket 110 and the control rod 124 to bias the control rod 124 against axial movement in the direction of the return stroke. As explained above, the wedge 22 will engage the push block 150 during the return stroke of the linear actuator 32 and axially move the control rod 124 in the direction of the return stroke. With axial movement of the control rod 124 in the direction of the return stroke of the linear actuator 32, the shoulder surface 162 will engage the effort end 134 of the trip arm 122 to move the trip arm 122 to its trip position T.

As shown, the shoulder surfaces 160 and 162 may be defined by respective collars 170 and 172 positioned on the control rod 124 between the eye bolts 140 and 142 supporting the control rod 124, for example. According to this example, the spring 164 may be a coil spring positioned on the control rod 124 and engaged between the eye bolt 140 and the collar 170, with abutment between the eye bolt 142 and the collar 172 operating to limit the permissible axial movement of the control rod 124 against the direction of the return stroke of the linear actuator 32. As generally shown, the axial position of the control rod 124 in relation to the collars 170 and 172 may be selectively fixed by set screws, for example. It will be understood that the specific operative position of the push block 150 behind the wedge 22 fixed to the linear actuator 32, and by extension, the point at which the wedge 22 will engage the push block 150 during the return stroke of the linear actuator 32, may be adjusted to suit a particular length log 16.

Figure 4A:
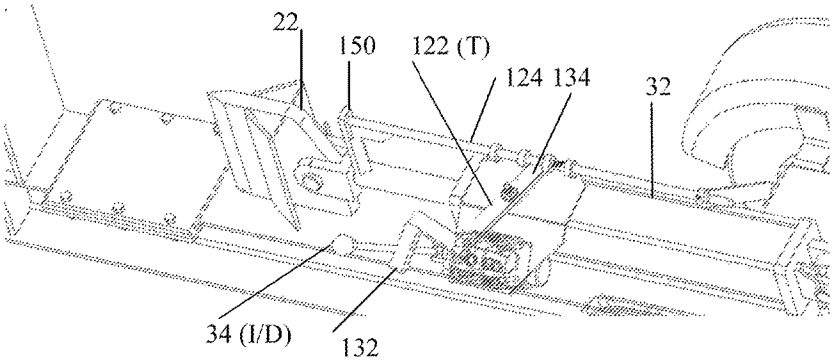
FIGS. 4A-C include perspective views of the return stroke limiter installed to the log splitter, showing the operation of the return stroke limiter during the commencement of an extension stroke at the beginning of the log splitter's work cycle.

The work cycle for the log splitter 10 as modified by the installed return stroke limiter 100 is shown in FIGS. 4A-C and 5A-C. As shown in FIG. 4A, initially, with the wedge 22 having engaged the push block 150 during a return stroke of the linear actuator 32 in a previous work cycle, the control rod 124 is axially moved in the direction of the return stroke, the shoulder surface 162 of the collar 172 is engaged with the effort end 134 of the trip arm 122 to move the trip arm 122 to its trip position T and the load end 132 is engaged the control lever 34 to position the control lever 34 to its intermediate position I/D. The stroke of the linear actuator 32 is consequently deactivated. Further, the spring 164 is compressed between the eye bolt 140 and the collar 170 by the axial movement of the control rod 124 in the direction of the return stroke to bias the control rod 124 against axial movement in the direction of the return stroke.

Figure 4B:
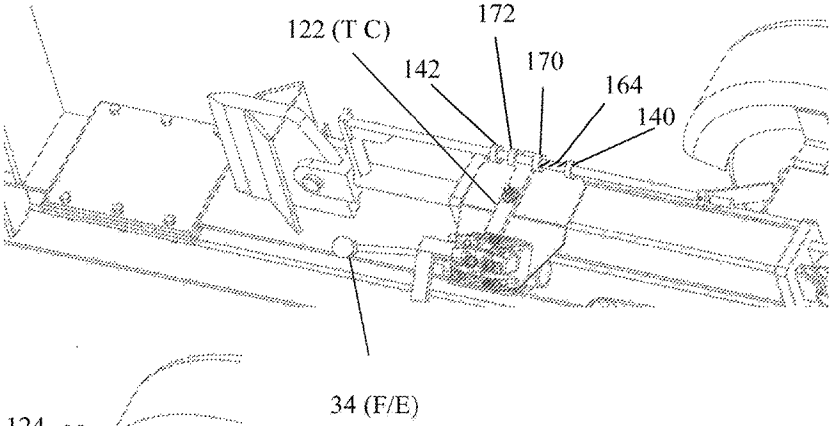
Figure 4C:
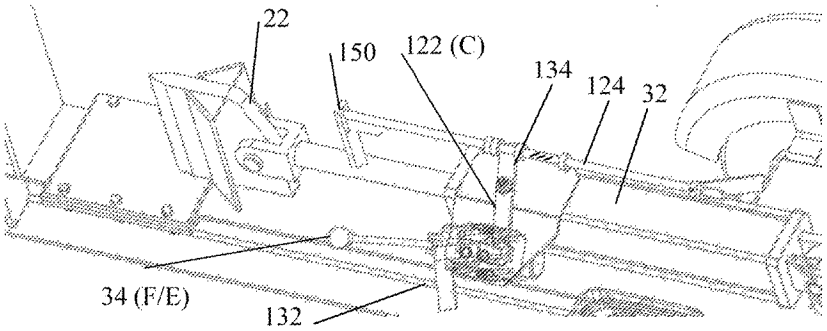

As shown in FIG. 4B, to begin a new work cycle, the control lever 34 is positioned in its forward position F/E to commence an extension stroke of the linear actuator 32. During the extension stroke, the linear actuator 32 advances the wedge 22 and the wedge 22 disengages the push block 150. Concurrently, the decompression of the spring 164 between the eye bolt 140 and the collar 170 axially moves the control rod 124 against the direction of the return stroke, and the shoulder surface 160 will engage the effort end 134 of the trip arm 122 to move the trip arm 122 to its clearance position C, as shown in FIG. 4C.

Figure 5A:
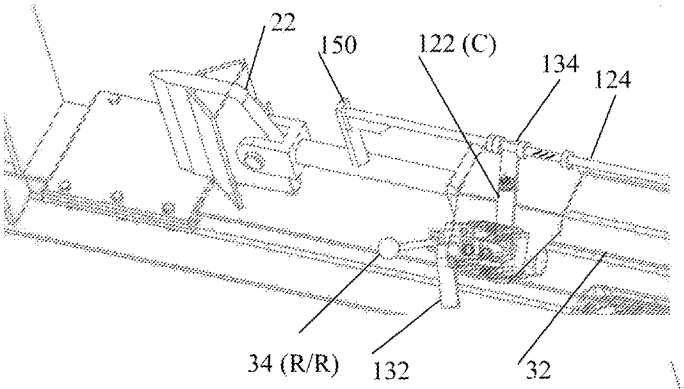
FIGS. 5A-5C include additional perspective views of the return stroke limiter installed to the log splitter, showing the operation of the return stroke limiter to deactivate a return stroke before its otherwise normal completion and thereby end the log splitter's work cycle.

With the trip arm 122 in its clearance position C, the control lever 34 may be positioned in its intermediate position I/D or its rearward position R/R. At the completion of the extension stroke, the control lever 34 is repositioned in its intermediate position I/D to deactivate the stroke of the linear actuator 32. Then, as shown in FIG. 5A, the control lever 34 is positioned in its rearward position R/R to commence a return stroke of the linear actuator 32.

Figure 5B:
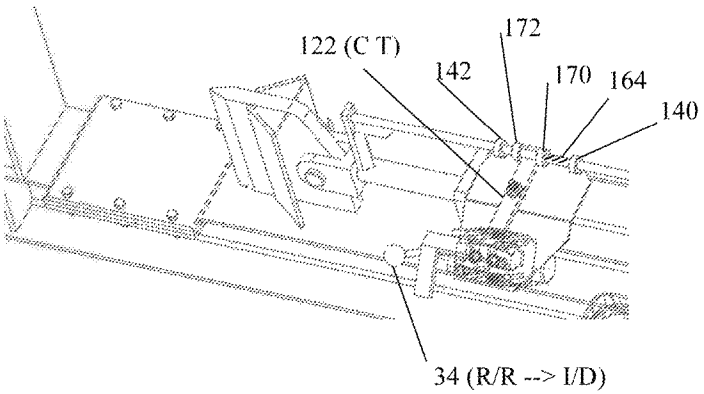

As shown in FIG. 5B, the wedge 22 engages the push block 150 during the return stroke of the linear actuator 32. Consequently, the control rod 124 is axially moved in the direction of the return stroke. Responsive to the axial movement of the control rod 124 in the direction of the return stroke, the shoulder surface 162 of the collar 172 engages with the effort end 134 of the trip arm 122 and the spring 164 is compressed between the eye bolt 140 and the collar 170 to bias the control rod 124 against axial movement in the direction of the return stroke.

Figure 5C:
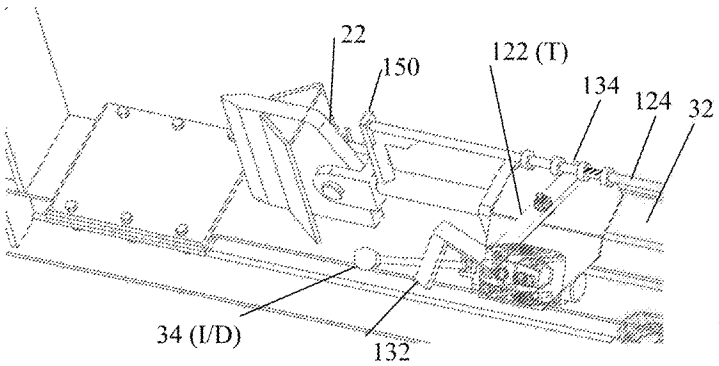

As shown in FIG. 5C, the engagement of the shoulder surface 162 of the collar 172 with the effort end 134 of the trip arm 122 moves the trip arm 122 to its trip position T. The trip arm 122 is thereby actuated, and the load end 132 of the trip arm 122 engages the control lever 34 to position the control lever 34 to its intermediate position I/D. The stroke of the linear actuator 32 is consequently deactivated before its otherwise normal completion, thus completing the work cycle. With the work cycle of the log splitter 10 completed, the wedge 22 and the footplate 24 are left in an open configuration accommodating the removal of the split log 16 and the placement of another longitudinally oriented log 16 between them on the loading platform 14.

With the limitation of the return stroke of the linear actuator 32 by the return stroke limiter 100, both time and energy are saved in association with the work cycle of the log splitter 10 with shorter length logs 16. These savings can be achieved over a variety of shorter length logs 16 by adjusting the specific operative position of the push block 150 behind the wedge 22 fixed to the linear actuator 32 to, in turn, adjust the point at which the wedge 22 will engage the push block 150 during the return stroke of the linear actuator 32 to cause its deactivation.

While recited characteristics and conditions of the invention have been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A log splitter, comprising:

a splitting assembly having a wedge, a foot place and a ram assembly that actuates at least one of the wedge and footplate;

a control lever coupled to the ram assembly for activating and deactivating an extension stroke and a return stroke of the ram assembly, wherein the control lever has a forward position activating the extension stroke of the log splitter, wherein the control lever has a rearward position activating the return stroke of the log splitter, and wherein the control lever has an intermediate position stopping the extension stroke or the return stroke; and a return stroke limiter comprising:

a trip arm comprising a load end and an effort end, wherein rotation of the load end causes movement of the control lever of the log splitter, and a control rod coupled to the effort end of the trip arm, the control rod comprising a first rod end, wherein translation of the first rod end causes the effort end of the trip arm to move in a direction of the translation and causes the load end of the trip arm to move in a direction opposite the direction of the translation, and wherein movement of the load end of the trip arm in the direction opposite the direction of the translation during the return stroke causes the control lever to move from the rearward position to the intermediate position.

2. The log splitter of claim 1, wherein the return stroke limiter further comprises: a push block coupled to the first rod end, wherein the push block is engaged by the wedge of the log splitter on the return stroke.

3. The log splitter of claim 2, wherein the control rod further comprises: a second rod end, wherein rotation of the second rod end causes the push block to rotate and disengage from the wedge.

4. The log splitter of claim 2, wherein the push block and the first rod end are coupled with a reinforcement.

5. The log splitter of claim 4, wherein the control rod further comprises: a handle coupled to a second end of the control rod, wherein rotating the handle rotates the push block.

6. The log splitter of claim 1, wherein movement of the load end of the trip arm in the direction opposite the direction of the translation of the control rod during the extension stroke causes the control lever to move from the forward position to the intermediate position.

7. The log splitter of claim 1, further comprising:

a control valve, wherein and the return stroke limiter further comprises:

a mounting bracket, wherein the trip arm is pivotally connected to the mounting bracket, and wherein the mounting bracket is fastened to the control valve.

8. The log splitter of claim 7, further comprising: a spacer disposed between the mounting bracket and the control valve.

9. The log splitter of claim 7, further comprising: eyebolts fastened to the mounting bracket for securing the control rod, wherein the effort end of the trip arm is coupled to the control rod between the eyebolts.

10. The log splitter of claim 9, further comprising: a collar placed between the effort end of the trip arm and one of the eyebolts; and a spring engaged between the one of the eyebolts and the collar to limit movement of the control rod during the return stroke.

11. The log splitter of claim 10, wherein the spring is decompressed during the extension stroke.

12. A method for limiting a return stroke of a log splitter, comprising:

using a wedge of the log splitter to split a log, a log splitter comprising:

a splitting assembly having the wedge and a ram assembly that actuates the wedge, a control lever coupled to the ram assembly for activating and deactivating an extension stroke and the return stroke of the ram assembly, and a return stroke limiter comprising:

a trip arm comprising a load end and an effort end, a control rod coupled to the effort end of the trip arm, the control rod comprising a first rod end, and a push block coupled to a first end of a control rod, engaging the push block with the wedge during the return stroke to translate the first end of the control rod in a direction of the return stroke;

using the translation of the first end of the control rod to rotate the effort end of a trip arm in the direction of the translation;

using the rotation of the effort end of the trip arm to rotate the load end of the trip arm in a direction opposite the translation to move the trip arm to a trip position; and using the rotation of the load end of the trip arm to move the control lever of the log splitter from a rearward position to an intermediate position to limit a length of the return stroke of the log splitter.

13. The method of claim 12, wherein the control rod includes a handle connected to a second end of the control rod, and the method further comprises:

rotating the handle in order not to engage the wedge and the push block on the return stroke of the log splitter.

14. The method of claim 12, further comprising:

moving the trip arm to a clearance position during an extension stroke of the log splitter, wherein when the trip arm is in the clearance position the control lever is moveable between the rearward position, the intermediate position, and a forward position and wherein the forward position activates the extension stroke of the log splitter.

15. The method of claim 12, wherein the trip arm is pivotally connected to a mounting bracket, and wherein the mounting bracket is fastened to a control valve of the log splitter.

16. The method of claim 15, wherein the control rod is secured to the mounting bracket with eyebolts fastened to the mounting bracket.

17. The method of claim 16, wherein shoulder surfaces are disposed between the eyebolts on the control rod and cradle the effort end of the trip arm.

18. The method of claim 17, further comprising:

limiting movement of the control rod during the return stroke with a spring engaged between one of the eyebolts and one of the shoulder surfaces.

19. The method of claim 15, wherein a spacer is disposed between the control valve and the mounting bracket to provide clearance between the mounting bracket and the log splitter.

20. A method for modifying an extension stroke of a log splitter, comprising:

in response to a control lever of the log splitter moving to a forward postition:

disengaging a push block from a wedge of the log spiltter, wherein the log splitter comprises:

a splitting assembly having the wedge and a ram assembly that actuates the wedge, the control lever coupled to the ram assembly for activating and deactivating the extension stroke and return stroke of the ram assembly, and a return stroke limiter comprising:

a trip arm comprising a load end and an effort end, a control rod coupled to the effort end of the trip arm, the control rod comprising a first rod end, and the push block connected to a first end of a control rod, and wherein disengaging the push block causes the first end of the control rod to translate in a direction of the extension stroke and the log splitter to perform the extension stroke;

using the translation of the first end of the control rod to rotate the effort end of the trip arm of the return stroke limiter in the direction of the translation; and using the rotation of the effort end of the trip arm to rotate the load end of the trip arm in a direction opposite the translation to move the trip arm to a clear position, wherein the clear position allows the control lever to move to a rearward position activating the return stroke and an intermediate position stopping the return stroke or the extension stroke.

* * * * *